US005560961A

United States Patent [19]

Adel et al.

[11] Patent Number: 5,560,961

[45] Date of Patent: Oct. 1, 1996

[54] PROCESS OF MAKING METAL-COATED MELAMINE/FORMALDEHYDE RESIN FIBERS

[75] Inventors: Joerg Adel; Bernd Ziegler, both of Ludwigshafen; Erwin Hahn, Heidelberg; Georg Mermigidis, Ellwangen/Jagst, all of Germany

[73] Assignee: BASF Aktiengesellschaft, Ludwigshafen, Germany

[21] Appl. No.: 370,980

[22] Filed: Jan. 10, 1995

Related U.S. Application Data

[62] Division of Ser. No. 137,490, Oct. 18, 1993, abandoned, which is a continuation of Ser. No. 919,335, Jul. 27, 1992, abandoned.

[30] Foreign Application Priority Data

Aug. 2, 1991 [DE] Germany ..... 41 25 601.8

[51] Int. Cl.$^6$ ..... B05D 3/04

[52] U.S. Cl. ..... 427/304; 427/306

[58] Field of Search ..... 427/404, 304, 427/306

[56] References Cited

U.S. PATENT DOCUMENTS

| | | | |
|---|---|---|---|
| 3,329,512 | 7/1967 | Shipley, Jr. et al. | 106/1 |
| 3,874,882 | 4/1975 | Gulla et al. | 106/1 |
| 4,370,214 | 1/1983 | Kadija | 204/242 |

*Primary Examiner*—Christopher Raimund
*Attorney, Agent, or Firm*—Keil & Weinkauf

[57] ABSTRACT

A process for the production of metal coated melamine-formaldehyde fibers is disclosed. Prior to coating, the fibers are first activated. Activation consists of applying a metal layer to the fibers by reducing a water soluble cobalt, copper or nickel salt with either: 1) a less noble metal or metal salt or 2) a hydride compound and a complexing agent. The desired metal coating is then applied to the pretreated fibers by reducing a water soluble salt of the metal with a reducing agent in the presence of a complexing agent.

4 Claims, No Drawings

PROCESS OF MAKING METAL-COATED MELAMINE/FORMALDEHYDE RESIN FIBERS

This is a divisional of application Ser. No. 08/137,490, filed Oct. 18, 1993, now abandoned, which is an FWC of Ser. No. 07/919,335, filed Jul. 27, 1992, now abandoned.

The present invention relates to metal-coated melamine/formaldehyde resin fibers.

The present invention furthermore relates to a process for the production of these fibers, use for the production of composite materials and composite materials which contain these fibers.

Electromagnetic waves may act as interfering radiation and, for example, have an adverse effect on communication and electronic data processing. Attempts have therefore been made to find materials capable of reflecting interfering electromagnetic waves.

Thus, shielding against electromagnetic radiation in the frequency range from 10 kHz to 10 GHz is becoming increasingly important, for example in the future development of computer housings of plastic. In order to provide plastics with shielding properties, conductive fillers, such as graphite (carbon black), metal powders, flakes and fibers and metallized glass or carbon fibers, may be added to them.

German Published Application DAS 2,743,768 discloses polyacrylonitrile and cotton fibers metallized with nickel or copper.

DE-A 38 10 597 describes composite materials which contain metallized fibers. The fibers used are glass fibers, Aramid fibers and carbon fibers, which can be metallized in a conventional manner, for example by electroless or electrochemical metallization, by sputtering or by vapor deposition. According to DE-A 38 10 597, the metallized fibers are provided with a polymeric protective layer.

The disadvantages of the conductive fillers known to date for plastics are, in some cases, the excessively high densities, excessively low flexibilities, insufficient heat resistance, poor flameproofing properties and uneconomical production processes.

It is an object of the present invention to produce metallized fibers which do not have the stated disadvantages.

We have found that this object is achieved by the metal-coated melamine/formaldehyde resin fibers defined at the outset.

We have also found a process for the production of the novel fibers, the use of these fibers for the production of composite materials and composite materials which contain these fibers.

Fibers of melamine/formaldehyde condensates and their production are disclosed in, for example, German Published Application DAS 2,364,091, EP-B 93965 and Chemiefasern/Textilindustrie, 40th/92nd year, December 1990, T154. As a rule, these fibers contain not less than 80% by weight of a melamine/formaldehyde precondensate, which is composed of melamine and formaldehyde in a molar ratio of melamine to formaldehyde of from 1:1.5 to 1:4.5, and in addition not more than 20% by weight of other amino-, amido-, hydroxyl- or carboxyl-containing precursors of thermosetting plastics on the one hand and aldehydes on the other hand. The fibers can then be produced therefrom by a conventional process, as described in, for example, the abovementioned literature.

In general, melamine/formaldehyde resin fibers having a diameter of from 5 to 100 μm, preferably from 8 to 20 μm, are used. Both rovings and chopped strands having a length of from 1 to 200 mm, preferably from 1 to 50 mm, may be used for coating.

However, it is also possible to use sheet-like structures produced from the fibers, such as woven fabrics, knitted fabrics or nonwovens.

In principle, all transition metals may be used as metals for coating fibers. Examples are chromium, molybdenum, tungsten, manganese, iron, cobalt, nickel, palladium, platinum, copper, silver and gold, preferably molybdenum, cobalt, nickel, palladium, platinum, copper, silver and gold, particularly preferably nickel, copper, molybdenum, palladium, silver, platinum and gold.

The thickness of the metal coating is chosen to be, as a rule, from 0.01 to 1 μm, preferably from 0.2 to 0.5 μm.

The weight ratio of fiber to metal is chosen to be in general from 100:1 to 0.5:1, preferably from 4:1 to 1:1.

Coating with metal in aqueous solution is generally carried out by first providing (activating) the surface of the fibers with metal nuclei in a first stage and then depositing the desired metal on this layer. Coating may also be carried out by decomposing the transition metal carbonyl compounds in a conventional manner, for example by thermolysis (chemical vapor deposition) or photolysis, in the presence of the melamine resin fibers.

Activation or initial coating of the melamine fibers can be achieved in a conventional manner by treating the fibers with an aqueous solution containing a water-soluble metal salt and a further less noble metal salt as a reducing agent (cf. for example WO 89/06710).

Suitable metal salts are, for example, the water-soluble salts of palladium, platinum, copper, silver or gold, such as palladium dichloride, platinum dichloride, copper(I) chloride, copper(II) sulfate, silver nitrate and gold(III) chloride, preferably palladium(II) chloride, silver nitrate and gold(III) chloride.

Tin(II) chloride or titanium(III) chloride is preferably used as the reducing agent.

The metal salt is preferably used in the form of its aqueous solution in concentrations of from 0.1 to 5, preferably from 0.2 to 0.5, g/l. The molar ratio of the reducing agent to metal salt is as a rule from 1:1 to 4:1, preferably from 1:1 to 2:1.

The fibers are generally used in amounts from 0.1 to 10, preferably from 0.5 to 1, % by weight (based on the amount of water).

The reaction is carried out in general at room temperature and under atmospheric pressure, but higher temperatures and pressures may also be chosen, preferably up to 95°0 C. and up to 500 kPa.

The pH at the beginning of the activation is not generally critical and depends essentially only on the substances used and the amount of each of these.

Melamine resin fibers can also be activated by treating them with an aqueous solution containing a water-soluble metal salt, a complexing agent and a hydride compound as a reducing agent.

In general, an aqueous solution consisting of the metal salt and the complexing agent is first prepared. After a constant pH has been established, the fibers are added and the reducing agent is then introduced, advantageously a little at a time, until precipitation of the metal at the point of dropwise addition occurs. Thereafter, the solution is stirred or shaken until no further brightening of the solution is observable. As a rule, the fibers become discolored. In general, the process of the addition of the reducing agent is repeated until no further deepening of the color of the fibers is detectable. Preferably, the reducing agent is added until the pH of the solution has increased by from 1 to 2, preferably from 1.25 to 1.75, units.

In principle, all water-soluble transition metal salts may be used as the metal salts. Examples are cobalt(II) chloride, nickel(II) chloride, palladium(II) chloride, platinum(II) chloride, copper(II) sulfate, silver nitrate and gold(III) chloride, preferably nickel-(II) chloride, palladium(II) chloride, platinum(II) chloride, copper(II) sulfate, silver nitrate and gold(III) chloride, particularly preferably palladium(II) chloride, copper(II) sulfate, silver nitrate and gold(III) chloride.

The complexing agents used may as a rule be organic complexing agents, such as carboxylic acids or carboxylic acid derivatives, for example citric acid, trisodium citrate, sodium acetate, salicylic acid, potassium sodium tartrate, succinic acid, glycine, L-aspartic acid or L-glutamic acid, alcohols or alcohol derivatives, for example glycerol, 1,3-propanediol, ethylene glycol, 3-amino-1-propanol or mannitol, and acetylacetone, 2-propanethiol, ethyl acetoacetate, ethylenediaminetetraacetate (EDTA), biuret or crown ethers, such as 15-crown-5 and 18-crown-6, preferably citric acid, trisodium citrate or glycine, particularly preferably citric acid.

In general, sodium borohydride or the borane/dimethylamine complex, preferably sodium borohydride, is used as the hydride compound in the activation.

The metal salt may be used in a concentration range of from 0.01 to 1, preferably from 0.05 to 0.2, g/l.

The fibers are used in general in amounts of from 0.1 to 10, preferably from 0.5 to 1, % by weight (based on the amount of water).

The amount of complexing agent is as a rule from 100 to 400, preferably from 100 to 200, mol % (based on the metal salt).

The amount of reducing agent is chosen in general to be from 100 to 400, preferably from 100 to 200, mol % (based on the metal salt).

The reaction is carried out as a rule at from 10° to 50° C., preferably from 15° to 35° C., under atmospheric pressure.

The pH at the beginning of the reaction is essentially dependent on the metal salt chosen and is as a rule less than pH 7.

The duration of the activation is not critical. It is chosen as a rule to be from 30 to 300, preferably from 60 to 120, minutes.

If a copper salt is used, as a rule a layer of Cu(I) oxide is first formed on the fiber surface, which oxide is usually further reduced with a basic, aqueous reduction solution to give metallic copper. The reducing agent used is preferably a hydride compound. In the reduction to the metal, discoloration of the fibers occurs as a rule. In general, the process of the addition of the reduction solution is repeated until no further deepening of the color of the fibers is detectable.

In general, sodium borohydride or the borane/dimethylamine complex, preferably sodium borohydride, is used as the hydride compound in the reduction of Cu(I) oxide.

In general, an alkali metal or alkaline earth metal hydroxide or oxide, such as lithium oxide, sodium hydroxide, potassium hydroxide, sodium oxide, magnesium hydroxide or calcium hydroxide, preferably sodium hydroxide or potassium hydroxide, is used as a base in the solution for reducing Cu(I) oxide.

The amount of hydride compound in the solution for reducing Cu(I) oxide is usually chosen in the range from 1 to 5 g/l of water. The amount of base is chosen as a rule in the range from 0.1 to 1 g/l of water.

The reduction of the Cu(I) oxide is generally carried out at from 10° to 50° C., preferably from 15° to 35° C., under atmospheric pressure The pH of the solution for reducing the Cu(I) oxide is chosen to be in general from 7 to 14, preferably from 10 to 12.

As a rule, the duration of the Cu(I) oxide reduction is chosen to be from 30 to 300, preferably from 60 to 120, minutes.

The actual coating of the melamine resin fibers is effected in general by treating the melamine resin fibers, pretreated according to the methods described above, with an aqueous solution containing a water-soluble metal salt, a complexing agent and a reducing agent.

For this purpose, a solution of the water-soluble metal salt in water is generally first prepared and the complexing agent is then added. Thereafter, the pH advantageous for the reduction is generally established, after which the reducing agent, preferably in the form of an aqueous solution, is added. The melamine resin fibers may then be added batchwise or continuously.

In principle, all water-soluble transition metal salts may be used as the metal salt. Examples are cobalt(II) chloride, nickel(II) chloride, palladium(II) chloride, platinum(II) chloride, copper(II) sulfate, silver nitrate and gold(III) chloride, preferably nickel(II) chloride, palladium(II) chloride, platinum(II) chloride, copper(II) Sulfate, silver nitrate and gold(III) chloride, particularly preferably palladium(II) chloride, copper(II) sulfate, silver nitrate and gold(III) chloride.

In general, tartrates, such as potassium sodium tartrate, dipotassium tartrate, disodium tartrate, potassium tartrate, sodium tartrate or diammonium tartrate, trisodium citrate and EDTA are used as complexing agents.

The reducing agent generally used is formaldehyde, advantageously in the form of an aqueous solution, sodium borohydride, the borane/dimethylamine complex, sodium hypophosphite ($NaH_2PO_2$. $H_2O$) or hydrazine. Sodium borohydride is preferably used for reducing copper and nickel, formaldehyde for reducing copper and silver, and the borane/dimethylamine complex and sodium hypophosphite for reducing nickel.

The choice of the pH depends essentially on the choice of the reducing agent. Thus, a pH of from 10 to 14 is generally chosen for the reduction with formaldehyde, the solution as a rule being rendered basic with an alkali metal hydroxide or oxide, eg. sodium hydroxide or potassium hydroxide. In the reduction with hypophosphite and with the borane/dimethylamine complex, a pH of from 5 to 10 is preferably chosen. The pH is established in general here with buffer systems conventionally used in these ranges, for example $NH_3/NH_4Cl$ or acetic acid/sodium acetate. In the reduction with sodium borohydride, a pH of from 7 to 14 is generally used, the reduction solution as a rule being rendered basic with an alkali metal hydroxide or oxide, eg. sodium hydroxide or potassium hydroxide.

The metal salt may be used in a concentration range of from 5 to 200, preferably from 10 to 50, g/l.

The fibers are used in general in amounts of from 0.1 to 10, preferably from 0.3 to 1, % by weight (based on the amount of water).

The amount of complexing agent is as a rule from 100 to 400, preferably from 100 to 200, mol % (based on the metal salt).

The amount of reducing agent is chosen in general to be from 100 to 400, preferably from 100 to 200, mol % (based on the metal salt).

The choice of the temperature depends in general on the particular metal. As a rule, the metallization may be carried out at from 15° to 95° C., preferably from 15° to 35° C, and under atmospheric pressure. A temperature range of from 60° to 95° C. is preferred for metallization with nickel and a temperature range of from 50° to 80° C. for metallization with silver.

The duration of the metallization depends essentially on the desired layer thickness and on the chosen concentrations of the starting materials. It is chosen as a rule to be from 30 to 300, preferably from 60 to 120, minutes.

The metallization of the melamine resin fibers with transition metal carbonyl compounds can be carried out by thermolysis or photolysis of the carbonyl compound.

The carbonyl compound is preferably decomposed in the presence of the fibers in an inert atmosphere to give the metal and carbon monoxide, advantageously by converting the carbonyl compound into the gas state, for example by sublimation or vaporization, and then decomposing it on the surface of the fibers by thermolysis.

In a preferred embodiment, the carbonyl compound is sublimed or vaporized outside the reaction vessel under inert gas, a stream of an inert gas, such as nitrogen, helium or argon, transporting the gaseous carbonyl compound into the reaction vessel and onto the surface of the fibers. The inert gas, undecomposed carbonyl compound and carbon monoxide are allowed to escape through an orifice in the reaction vessel.

Suitable transition metal carbonyl compounds are chromium hexacarbonyl, molybdenum hexacarbonyl, tungsten hexacarbonyl, iron pentacarbonyl, iron enneacarbonyl, manganese decacarbonyl, cobalt octacarbonyl and nickel tetracarbonyl, preferably molybdenum hexacarbonyl and tungsten hexacarbonyl, particularly preferably molybdenum hexacarbonyl.

The temperature at the fiber surface is chosen in general to be in the range from the decomposition temperature of the carbonyl compound as a lower limit to the decomposition temperature of the fibers as an upper limit. As a rule, the temperatures are from 100° to 250° C., preferably from 150° to 240° C.

The temperature for the sublimation or vaporization of the carbonyl compound depends essentially on the type of metal and on the pressure. These values are known (cf. for example CRC Handbook of Chemistry and Physics 71st Edition, 1990–1991). For example, molybdenum hexacarbonyl is preferably heated to 50°–120° C., particularly preferably 70°–90° C.

The amount of carbonyl compound depends essentially on the desired layer thickness on the fibers, the diameter and the amount of fibers. As a rule, from 0.1 to 30, preferably from 1 to 20, mmol of carbonyl compound are used per g of fiber.

The reaction is carried out in general under atmospheric pressure.

The reaction time is chosen as a rule to be from 15 to 300, preferably from 60 to 120, minutes.

The novel metal-coated melamine resin fibers can be processed in a conventional manner together with other polymeric molding materials, such as thermoplastics and thermosetting plastics, to give composite materials.

Conventional methods are used for the production of composite materials with thermoplastics. For example, the thermoplastic can be melted in a heatable mixing unit and the novel metallized melamine resin fibers, in the form of rovings or chopped strands, can be incorporated into the melt. Thereafter, the melt can be extruded, injection molded or compression molded.

The preparation of composite materials with thermosetting plastics is likewise generally carried out by conventional methods, for example by impregnating the novel melamine resin fibers with the liquid starting materials and then effecting curing.

All known thermoplastics and thermosetting plastics and mixtures thereof can be used as the polymer matrix. Examples are polyamides, polyvinyl chloride, polyolefins, polyesters, aromatic polyethers, unsaturated polyester resins and polyurethanes.

The amount of the novel melamine resin fibers is chosen as a rule to be from 1 to 40, preferably from 5 to 25, % by weight, based on the weight of the composite material.

The novel composite materials may furthermore contain the conventional additives and processing assistants, such as stabilizers, flameproofing agents, impact modifiers, antioxidants, lubricants, fillers and dyes and pigments and carbon black and/or graphite.

Compared with known metallized fibers or metal fibers, the novel melamine resin fibers are distinguished by their low density, their high flexibility, their economical production, their excellent flameproofing properties and their very good heat resistance.

EXAMPLES

The determinations of the metal content of the fibers in the experiments below were carried out by means of atomic absorption spectroscopy.

The conductivity was determined by a four-point method on individual fibers. For this purpose, a current of 100 mA was passed through the fiber by means of two platinum electrodes (pair A) , which were a distance of about 1 cm apart and were connected to the fiber surface. Two further electrodes (pair B) 0.33 cm apart were then mounted in the region between the two electrodes. The voltage U was measured by means of the electrode pair B.

The specific conductivity of the fibers, $\kappa_{fiber}$, can then be determined from the known parameters (the current I, the distance between the electrodes (pair B) l and the cross-section of the conductor q) and the measured voltage U, according to equation 1:

$$\kappa_{fiber}=I\cdot l/(U\cdot q) \qquad \text{Equation 1}$$

The cross-section of the fibers was calculated using the density $\rho_m$=2.42 g/cm$^3$, the amount m weighed in and the length of the fiber, according to Equation 2:

$$q=m/(\rho_m\cdot l_{fiber}) \qquad \text{Equation 2}$$

EXAMPLE 1

Production of copper-coated melamine resin fibers (a) Activation of the melamine resin fibers 1 g of melamine resin fibers (Basofil• O, BASF) was added to a solution of 0.063 g (0.25 mmol) of copper(II) sulfate pentahydrate, 0.053 g (0.25 mmol) of citric acid and 200 ml of water. Thereafter, 1.47 g (0.4 mmol) of a 1% strength by weight sodium borohydride solution were added a little at a time to the stirred solution in the course of 30 minutes, a change in the color of the fibers from white to yellowish brown being observed. The fibers were then washed with water. The pH was 3.1 at the beginning of the reaction and 4.6 at the end of the reaction.

(b) Reduction of the copper(I) oxide layer

The fibers obtained according to (a) were placed in a solution of 1.0 g (26 mmol) of sodium borohydride, 0.1 g (2.5 mmol) of sodium hydroxide and 300 ml of water for one hour. The fibers were then washed with water. (c) Copper-coating of the melamine resin fibers A mixture of 4.4 g (54 mmol) of a 37% strength by weight formalin solution and 43 ml (107 mmol) of a 10% strength by weight sodium hydroxide solution was added to a mixture of 4.32 g (17.3 mmol) of copper(II) sulfate pentahydrate, 9.66 g (34 mmol) of potassium sodium tartrate, 0.95 g (23.8 mmol) of sodium hydroxide and 300 ml of water. The fibers obtained under (b) were then added and were copper-coated in the course of two hours with gentle stirring. Thereafter, the copper-coated fibers were washed with water and ethanol and dried in the air at room temperature.

Cu content: 52% by weight.

Conductivity: $2 \cdot 10^4$ S/cm.

For comparison: Conductivity of an uncoated fiber, $10^{-12}$ S/cm.

EXAMPLE 2

Production of nickel-coated melamine resin fibers (a) Activation of the melamine resin fibers 1 g of melamine fibers (Basofil• O, BASF) was added to a solution of 0.25 mmol of nickel(II) chloride hexahydrate, 0.25 mmol of citric acid and 200 ml of distilled water after a constant pH of 3.24 had been established. After complete wetting of the melamine resin fibers, 1.47 g (0.4 mmol) of a 1% strength by weight sodium borohydride solution were added dropwise in such a way that the addition was interrupted each time the point of dropwise addition acquired a black coloration, and the solution was then stirred slowly until the black coloration had disappeared. This process was repeated until the solution was light gray and had a pH of 4.7. The fibers were then washed with distilled water.

(b) Nickel-coating of the melamine resin fibers 4.454 g (18.7 mmol) of nickel(II) chloride hexahydrate, dissolved in 40 ml of distilled water, were added to a solution of 9.853 g (33.5 mmol) of trisodium citrate 5.5 hydrate, 4.948 g (92.5 mmol) of ammonium chloride, 1.087 g (10.26 mmol) of sodium hypophosphite and 60 ml of distilled water. 9.976 g of a 25% strength by weight ammonium solution were then added. The solution was then heated to 96° C. Thereafter, 1 g of melamine resin fibers obtained under (a) was added to the solution and stirring was carried out for 90 minutes at 96° C. Thereafter, the nickel-coated fibers were washed, first with distilled water and then with ethanol, and were finally dried in the air. The gray fibers had a metallic gloss and a nickel content of 38% by weight.

EXAMPLE 3

Production of copper-coated melamine resin fibers (a) Activation of the melamine resin fibers with palladium(II) chloride 1 g of melamine resin fibers (Basofil• O, BASF) was added to a solution of 4.5 mg (0.025 mmol) of palladium(II) chloride, 0.053 g (0.25 mmol) of citric acid and 200 ml of water. The pH was brought to 2.4 by adding 0.7 ml of a 10% strength by weight hydrochloric acid solution. Thereafter, 1.47 g (0.4 mmol) of a 1% strength by weight sodium borohydride solution were added a little at a time to the solution in the course of 30 minutes while stirring, a change in the color of the fibers from white to gray being observed. The fibers were then washed with water. The pH was 3.9 at the end of the reaction.

Pd content: 0.16% by weight (b)/(c) A procedure similar to that under Example 1 (b) and (c) was then carried out, except that the duration of copper coating was 90 minutes.

Cu content: 55% by weight.

EXAMPLE 4

Production of copper-coated melamine resin fibers (a) Activation of the melamine resin fibers with silver nitrate 1 g of melamine resin fibers (Basofil• O, BASF) was added to a solution of 4.3 mg (0.025 mmol) of silver nitrate, 0.053 g (0.25 mmol) of citric acid and 200 ml of water (pH 7.9). 1.47 g (0.4 mmol) of a 1% strength by weight sodium borohydride solution were then added a little at a time to the solution in the course of 30 minutes while stirring, a change in the color of the fibers from white to gray being observed. The fibers were then washed with water. The pH was 9.4 at the end of the reaction.

Ag content: 0.31% by weight.

(b)/(c) A procedure similar to that under Example 1 (b) and (c) was then carried out, except that the duration of copper-coating was 180 minutes.

Cu content: 55% by weight.

EXAMPLE 5

Production of copper-coated melamine resin fibers (a) Activation of the melamine resin fibers with tetra-chloroauruic(III) acid 1 g of melamine resin fibers (Basofil• O, BASF) was added to a solution of 8.5 mg (0.025 mmol) of tetra-chloroauric(III) acid, 0.053 g (0.25 mmol) of citric acid and 200 ml of water (pH 3.5). 1.47 g (0.4 mmol) of a 1% strength by weight sodium borohydride solution were then added a little at a time to the solution in the course of 30 minutes while stirring, a change in the color of the fibers from white to gray being observed. The fibers were then washed with water. The pH was 5.0 at the end of the reaction.

Au content: 0.18% by weight. (b)/(c) A procedure similar to that under Example 1 (b) and (c) was then carried out, except that the duration of copper-coating was 140 minutes.

Cu content: 50% by weight.

EXAMPLE 6

Production of copper-coated melamine resin fibers (a) Activation of the melamine resin fibers with tin(II) chloride and palladium(II) chloride 10 g of melamine resin fibers (Basofil• O, BASF) ware added to a solution of 5.0 g of tin(II) chloride, 4.2 ml of a 38% strength by weight hydrochloric acid solution and 5 l of distilled water. After 5 minutes, the fibers were washed with distilled water and were dried at 80° C. Thereafter, the fibers pretreated in this manner were immersed in a solution of 0.05 g of palladium(II) chloride, 20 ml of a 10% strength by weight hydrochloric acid solution and 5 l of distilled water. The fibers were then washed with distilled water and were dried at 150° C.

The fibers activated in this manner were then added to a mixture of 43.2 g of copper(II) sulfate pentahydrate, 96.6 g of potassium sodium tartrate, 9.5 g of sodium hydroxide and 3 l of water. The copper-coating was then started with a mixture of 44 g of a 37% strength by weight formalin solution and 300 ml of a 10% strength by weight sodium hydroxide solution, the latter being added dropwise. After 40 minutes, the copper-coated fibers were washed with water and methanol and were dried in the air at room temperature.

Cu content: 50% by weight.

EXAMPLE 7

Production of molybdenum-coated melamine fibers

The experimental apparatus used essentially consisted of two glass flasks connected by means of a gas pipe and each having two orifices. One flask A served for vaporizing the carbonyl, while the fibers to be metallized were present in the other flask B. Pure nitrogen was passed in via the gas inlet in flask A and further through the gas pipe to flask B and was discharged via the gas outlet in flask B.

Flask B was charged with 2.05 g of melamine fibers (Basofil• O, BASF) and flask A with 8.75 g of molybdenum hexacarbonyl. Thereafter, flask B was heated to 240° C. and the entire apparatus was flushed for 1 hour with 200 l/h of pure nitrogen. The nitrogen stream then increased to 400 l/h and flask A was heated to 80° C. As a result, gaseous molybdenum hexacarbonyl was transported to the fibers at 240° C. and subjected to thermolysis there. The experiment was complete after 2 hours.

Mo content: 19.9% by weight

Conductivity: 1.1 S/cm.

We claim:

1. A process for the production of metal-coated melamine/formaldehyde resin fibers by first pretreating their surface with a metal layer and then coating them with the desired metal, wherein, in the presence of melamine/formaldehyde resin fibers, (Ia) first a water-soluble cobalt, copper or nickel salt is reduced with a less noble metal or metal salt, or (Ib) first a water-soluble cobalt, copper or nickel salt is reduced with a hydride compound in the presence of a complexing agent, whereby the hydride compound is added until the pH of the solution has increased by from 1 to 2 units, (II) optionally, the fibers treated according to steps (Ia) or (Ib) are further reduced with a basic, aqueous reduction solution to transfer cobalt, copper or nickel in a low oxidation state to the metallic state, (III) and then the desired metal is applied to the fibers by reducing one of its water-soluble salts with a reducing agent in the presence of a complexing agent.

2. The process of claim 1, wherein a cobalt salt is used in steps (Ia) and (Ib).

3. The process of claim 1, wherein a copper salt is used in steps (Ia) and (Ib).

4. The process of claim 1, wherein a nickel salt is used in steps (Ia) and (Ib).

* * * * *